United States Patent [19]

Toutin

[11] Patent Number: 4,586,420

[45] Date of Patent: May 6, 1986

[54] SYSTEM FOR FIRING A PROPELLENT CHARGE BY PYROTECHNICAL TRANSMISSION

[75] Inventor: Paul Toutin, St-Aubin-sur-Gaillon, France

[73] Assignee: Societe Europeenne de Propulsion, Puteaux, France

[21] Appl. No.: 541,072

[22] Filed: Oct. 12, 1983

[30] Foreign Application Priority Data

Oct. 14, 1982 [FR] France ..... 82 17226

[51] Int. Cl.[4] ..... F41F 15/00

[52] U.S. Cl. ..... 89/1.702; 89/27.12; 89/27.13; 102/275.6; 102/275.11

[58] Field of Search ..... 89/1.7, 1.701, 1.702, 89/1.703, 1.704, 1.705, 1.706, 1.807, 1.812, 1.813, 27.11, 27.12, 27.13, 27.14, 27.3; 102/202, 204, 222, 254, 261, 275.6, 275.11

[56] References Cited

U.S. PATENT DOCUMENTS

| | | | |
|---|---|---|---|
| 1,394,490 | 10/1921 | Giles | 89/1.702 |
| 3,015,275 | 1/1962 | Peyton et al. | 102/254 |
| 3,027,839 | 4/1962 | Grandy et al. | 102/275.5 |
| 3,097,564 | 7/1963 | Stevenson | 89/1.7 |
| 3,657,958 | 4/1972 | Wells | 102/261 |
| 3,677,131 | 7/1972 | Nee | 89/1.703 |
| 3,908,553 | 9/1975 | Beach | 102/254 |

FOREIGN PATENT DOCUMENTS

| | | | |
|---|---|---|---|
| 2446177 | 8/1976 | Fed. Rep. of Germany . | |
| 1418845 | 12/1975 | United Kingdom | 89/1.702 |

*Primary Examiner*—Stephen C. Bentley

*Attorney, Agent, or Firm*—Fitzpatrick, Cella, Harper & Scinto

[57] ABSTRACT

The invention relates to a system for firing a propellent charge by pyrotechnic transmission, comprising mechanical means of actuating a hammer, a primer cooperating with said hammer, and a propellent charge connected to the primer by pyrotechnical means and situated inside a firing tube.

The hammer and the primer are positioned excentrically with respect to the axis of the firing tube, and mechanical means, which cooperate with other mechanical means for actuating the hammer, are provided to break the pyrotechnic chain during storage and to cause the pyrotechnic chain to come in alignment when the hammer moves under the effect of the said mechanical means for actuating the hammer.

9 Claims, 8 Drawing Figures

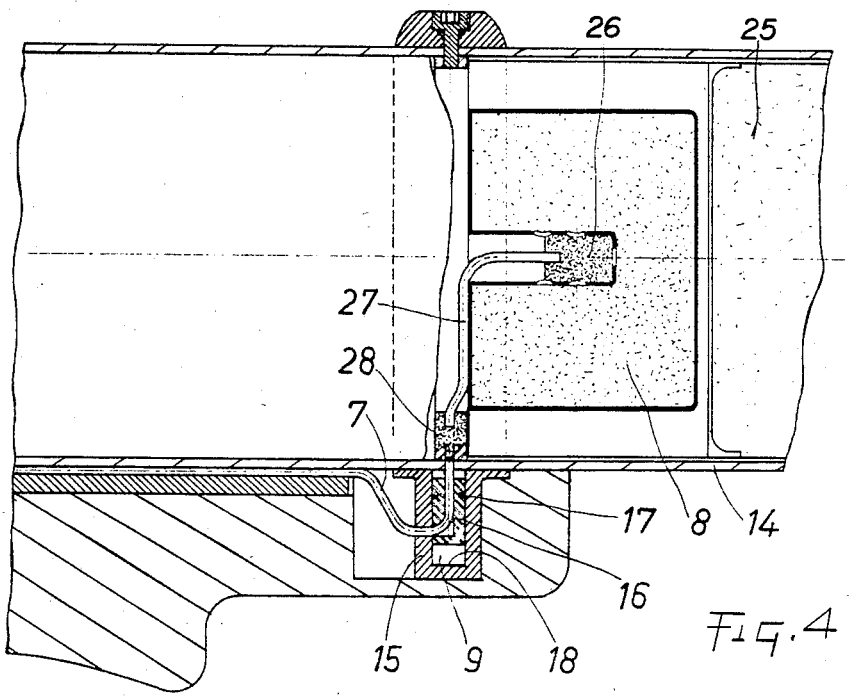
Fig. 4
Fig. 5
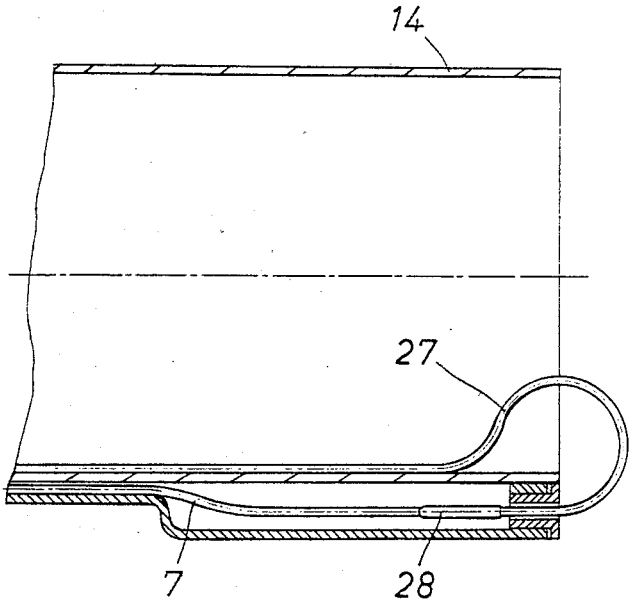

SYSTEM FOR FIRING A PROPELLENT CHARGE BY PYROTECHNICAL TRANSMISSION

The present invention relates to a system for firing a propellent charge by pyrotechnic transmission, comprising mechanical means of actuating a hammer, a primer cooperating with said hammer, and a propellent charge connected to the primer by pyrotechnical means and situated inside a firing tube.

It is known that the firing of projectiles can be effected either by pyrotechnic transmission with a hammer-primer type device, or by electrical transmission. The first method is generally used with shell-type ammunitions, whereas the second method is applied to rocket type contrivances.

It is the object of the present invention to apply a firing system, of the type using pyrotechnic transmission with hammer and primer, to advanced types of ammunitions, and to adapt said system to all safety requirements and in particular loading safety, and to discontinuing the pyrotechnical chain, with, in the case of complete arms in two parts, a safe connection between the firing tubes.

A further object of the invention is to propose a firing system which is applicable to any types of arms, made in one or two elements (re-loadable arms for example) and to any type of propulsion (tube booster, recoilless gun, rifle-bolt).

These objects are reached with a firing system of the type mentioned hereinabove, in which, according to the invention, the hammer and the primer are positioned excentrically with respect to the axis of the firing tube, and mechanical means, which cooperate with other mechanical means for actuating the hammer, are provided to break the pyrotechnic chain during storage and to cause the pyrotechnic chain to come in alignment when the hammer moves under the effect of the said mechanical means for actuating the hammer.

Spring means cooperate with the said mechanical breaking means to return same in their initial out-of-line position when the mechanical means for actuating the hammer are released.

According to one special embodiment of the invention, the mechanical breaking means comprise a rotary bush, one part of which, forming a cam, cooperates with the mechanical means for actuating the hammer.

Advantageously, said means for actuating the hammer cooperate with loading safety means which, when interlocked, prevent the said actuating means from moving.

According to the invention, the transmission of energy between the hammer and the propellent charge is exclusively achieved by a pyrotechnic transmission system.

According to a possible embodiment, the pyrotechnic transmission system comprises a pyrotechnic fuse which traverses the firing tube at the level of the propellent charge, sealing means being also provided where the tube is so traversed.

According to another possible embodiment, the pyrotechnic transmission system comprises two pyrotechnic fuses, internal and external to said firing tube, and connected together close to the back of said firing tube.

The energy from the hammer could also be transmitted directly to the propellent charge, namely without any transmission fuse, provided that said charge is situated close to the triggering handle.

According to a particular embodiment, the firing tube is produced in two parts which are connected together by means of a locking ring, a lock-check integral with the locking ring preventing the hammer from moving whilst locking is not complete.

Advantageously, the loading safety means can comprise a spring leaf provided with an opening, a push-member cooperating with said spring leaf so that, in a first position of said push-member, the spring leaf prevents all movements of the means actuating the hammer, whereas in a second position of the push-member, the opening in the spring leaf allows the passage of a lug integral with the means for actuating the hammer, this authorizing a free manoeuvering of said means.

The invention will be more readily understood on reading the following description with reference to the accompanying drawings, in which:

FIG. 4 shows part of an axial section of another embodiment of pyrotechnic transmission with a detonating fuse traversing the back of the firing tube.

FIG. 5 shows the rear portion of an axial section of another embodiment of pyrotechnic transmission with a detonating fuse passing at the back of the firing tube.

Figure 1:
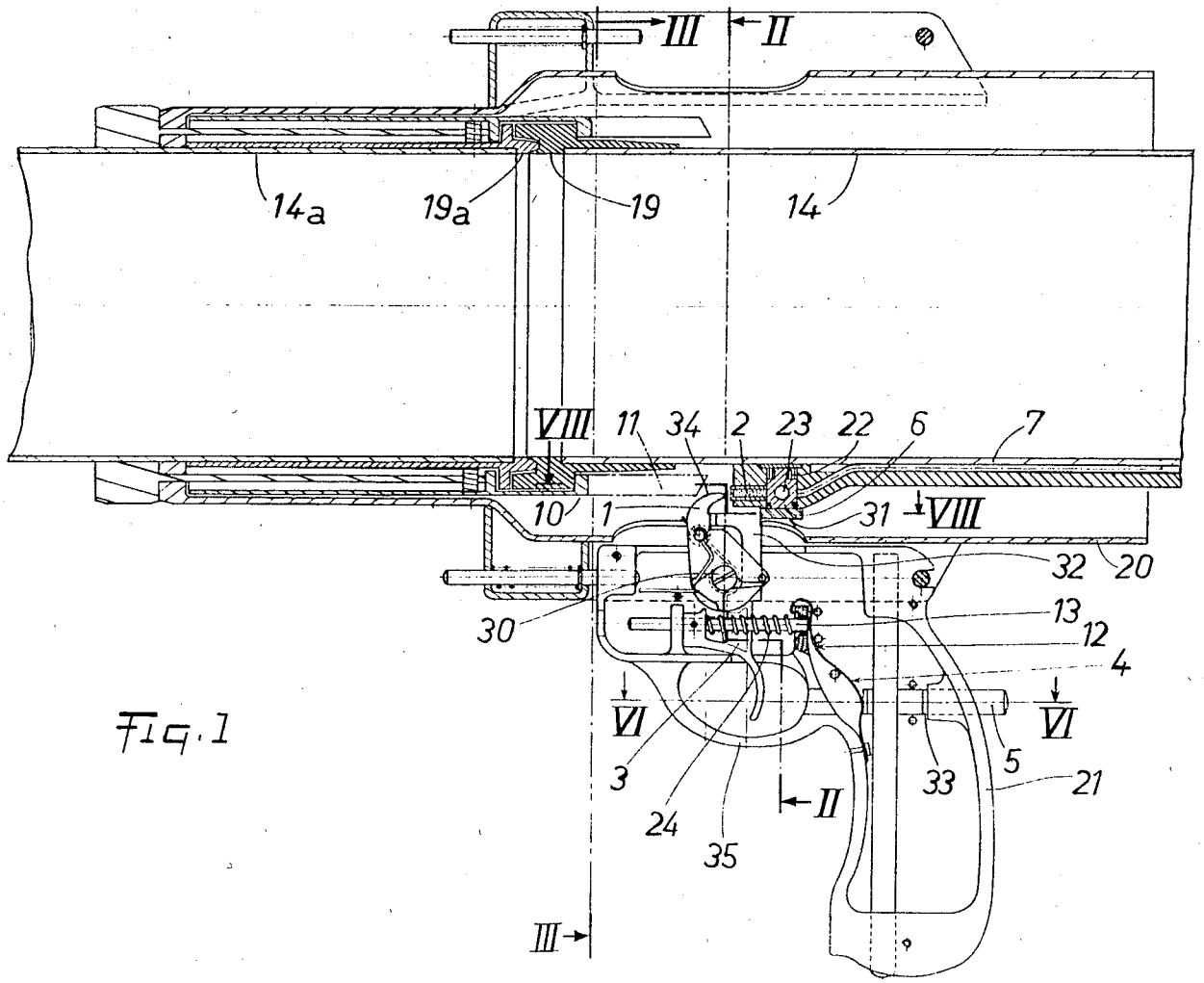
FIG. 1 is a partly elevational view of an axial section along line I—I of FIG. 2, of a gun with firing tube, equipped with a firing system according to the invention, the cover of the handle being removed.

Referring first to FIG. 1, this shows part of a fire-arm comprising a firing tube 14 open at both ends, and inside which are positioned, at the front of the tube 14, a projectile (not shown) which projectile can be equipped with a cruising propelling member, a propellent charge or cartridge 8 (FIG. 4) placed behind the projectile and a rifle-bolt 25 placed behind the propellent charge or cartridge 8. The rifle-bolt 25 may be constituted of a dispersable pulverulent ballast (FIG. 4).

FIG. 1 shows the whole assembly of the gun-firing device with, in particular, a supporting handle 21, a hand-operated push-button 5, to release the safety-catch, a trigger lever 3 and a hammer 1- primer 2 system. The assembly of the mechanisms of the firing device is mounted on a casing 20 which surrounds the firing tube 14 and can also support the aiming devices.

The present invention relates essentially to the gun firing device, which firing device is adaptable to different types of firearms and for example to guns designed to receive ammunitions of the type consisting of a container-firing tube inside which is placed the projectile and a firing device (charge and bolt).

The object of the invention is to enable the firing of a propellent charge by a purely pyrotechnic system which ensures complete safety until the shot is fired. All electrical transmission is therefore eliminated; but the different safety requirements are preserved, namely, the loading safety, the braking of the pyrotechnical chain and the safe connection between the firing tubes in the case of a firearm in two parts (such as shown in FIG. 1) wherein the two parts of the tube 14, 14*a* are joined together by an intermediate connecting ring 10 which cooperates with the ends 19, 19*a* of the tube parts.

As shown in FIG. 1, the point 34 of the hammer 1 is designed to cooperate with a primer 2 which, however, is kept out of line with the pyrotechnic transmission detonating fuse 7 by way of a bush 6 ensuring pyrotechnic safety until the shot is fired. Said hammer 1 and primer 2 are situated excentrically with respect to the axis of the firing tube 14 immediately beneath said tube 14, at the level of the handle which can have the conventional shape of a butt 21 and of a trigger guard 35. It will be noted that the energy from the primer 2 could even be transmitted directly to the propellent charge, without any detonating fuse 7, provided that the charge is situated close to the firing handle 21, 35. In this case, the role of the bush 6 would nevertheless remain the same.

Figure 2:
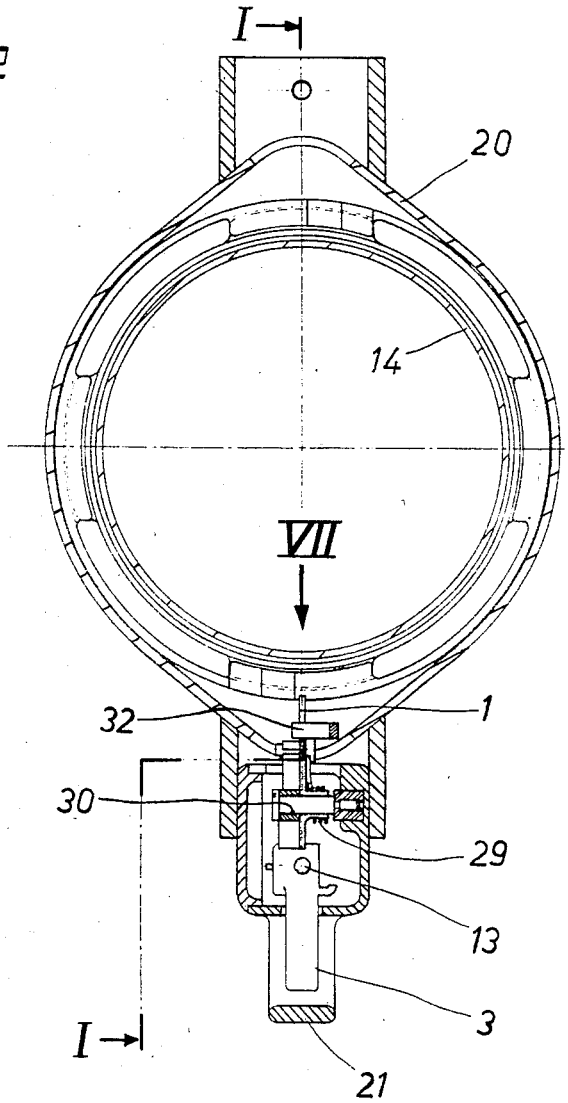
FIGS. 2 and 3 are cross-sectional views along lines II—II and III—III of FIG. 1, respectively with and without the cover on the handle.
Figure 3:
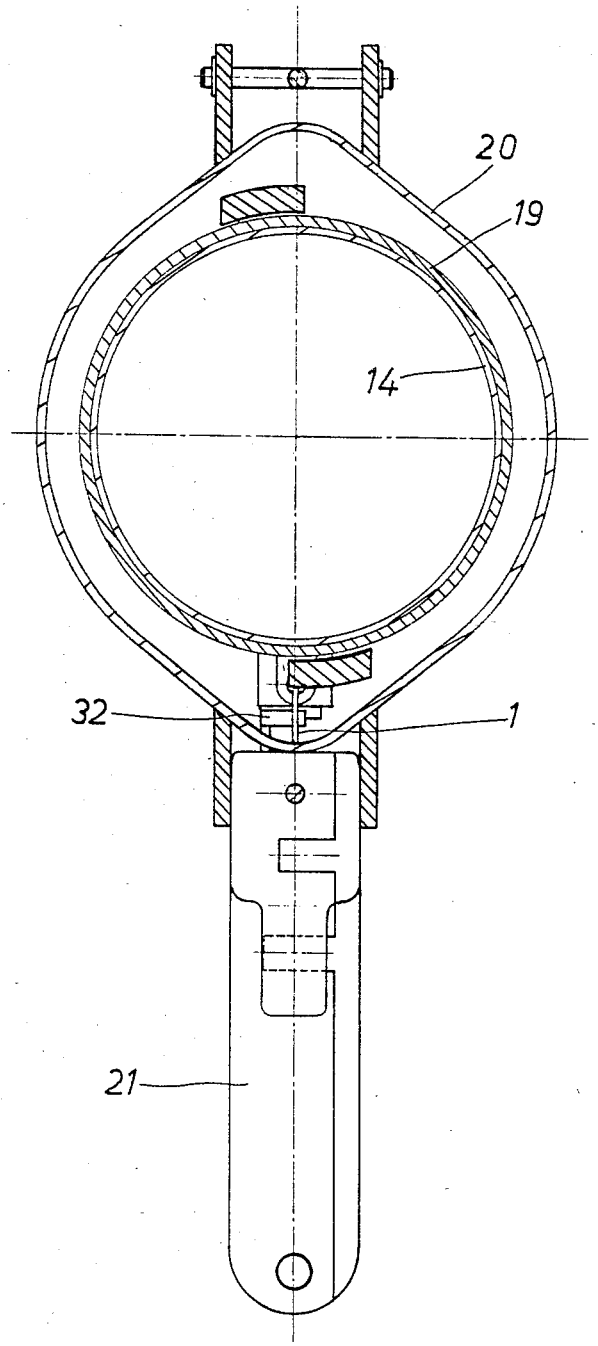
Figure 6:
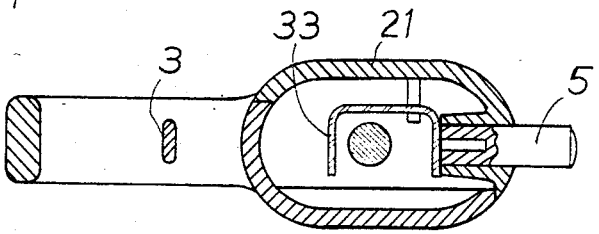
FIG. 6 is a cross-section along line VI—VI of FIG. 1.
Figure 7:
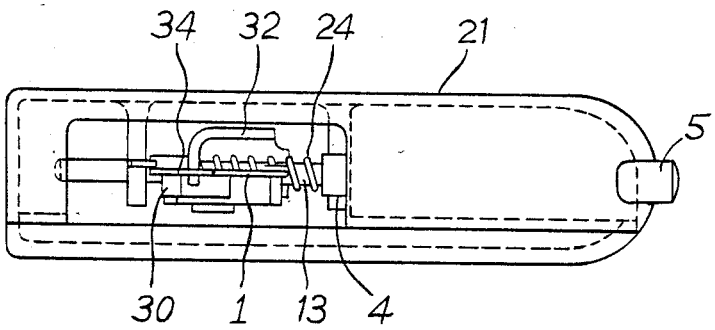
FIG. 7 is a plan view of the handle of the gun shown in FIG. 1.

The hammer 1 which cooperates with a spring 29 (FIG. 2) and is designed to pivot about an axle 30 is actuated by the trigger lever 3, which trigger lever can only be moved if the safety catch constituted by the spring leaf 4 and a push member 5 is released. Said safty-catch is released by the user of the gun who presses with the palm of his hand on the push-member 5 adapted to slide inside a bore provided in the butt 21. When pushed to the left of FIG. 1, said push-member 5, whose inner end is constituted by a U-shaped piece 33 (FIG. 6) deforms the spring leaf 4 and enables to bring an opening 12 provided in said spring leaf 4 to coincide with the axle of the trigger lever 3. Said trigger lever 3 can then be moved by the finger of the user, against the force exerted by a spring 24 coiled around the axle 13 of the trigger lever.

The movement of the trigger lever 3, besides its conventional function which is to tip the hammer 1 over so that it can store the energy necessary to strike the primer 2, also enables to pivot the bush 6 owing to an extending portion or spike 32 integral with the upper part of the body of the trigger lever 3, which acts on a cam 31 integral with said cylindrical bush 6. FIG. 1 shows the cylindrical bush 6 in the closed position, with its central orifice 23 perpendicular to the primer 2 and to the pyrotechnic fuse 7. When the user presses on the trigger 3, the spike 32 drives in rotation the cam 31 and the bush 6 integral with the cam 31, aligning, in doing so, the orifice 23 of the bush 6 with the primer 2. If the user, deciding not to fire, releases the trigger 3, the spiral spring 22 which is mounted on the bush 6 returns the latter to the closed position, the cam 31 also returning to its initial position corresponding to the rest position.

Figure 8:
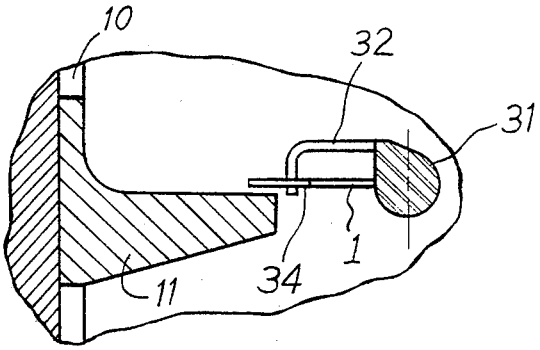
FIG. 8 is a section along line VIII—VIII of FIG. 1 showing the control of the means of interruption of the pyrotechnic chain.

In the case of a re-loadable gun in two parts, on which two tube parts 14, 14*a* are joined together by the rotation of a ring 10 (FIG. 1), a rod 11 integral with said ring 10 and constituting a lock check prevents the hammer 1 from tipping over before locking is complete (FIG. 8). This particular arrangement offers total safety of firing, and prevents all losses of pressure where the two tubes 14,14*a* are joined together. Thus, a partial rotation of the pivoting ring 10 leaves the lock check 11 behind the hammer and prevents the latter from tipping over.

The pyrotechnic chain breaking system which comprises a pivoting bush 6 could also be produced, according to another embodiment, by means of a retractable flap or any other equivalent mechanical system, as long as it can cooperate with the trigger 3 to break the pyrotechnic chain at loading time and align said chain when the shot is fired on moving the trigger, whilst ensuring reversibility.

As illustrated in FIG. 4, once the primer 2 has been struck, the shot is transmitted to the primer 26 of the propellent charge 8 via the pyrotechnic transmission fuse 7, or any equivalent pyrotechnic system, traversing the tube 14, at the level of the charge 8, by means of a sealing system 9 which is necessary to prevent any leaks of the gases produced by the charge 8, where detonating fuse 7 traverses the firing tube 14. This ensures safety for the person firing the shot and a good functioning of the whole assembly.

The sealing system 9 essentially comprises a cylinder 15 and a piston 16 equipped with a sealing ring 17, which is movable inside the cylinder 15. The fuse 7 penetrates sideways into the cylinder 15 and the piston 16, beneath the sealing ring 17 and, having gone through the wall of tube 14, connects up via coupling member 28 with the portion of fuse 27, which in turn is connected with the igniting composition 26 of the charge 8. In the rest position, the piston 16 is high up, as illustrated in FIG. 4. When the propellent charge 8 is ignited, the pressure of the gases pushes the piston 16 downwards and causes the severing of the fuse envelope where it traverses the side wall of the cylinder 15. The piston 16 then abuts on the bottom 18 of the cylinder 15. Tightness is ensured by the sealing ring 17 which remains in position above the level of introduction of the detonating fuse 7 into the cylinder 15. In the rest position, the piston 16 is advantageously stuck in its bore in order to prevent the detonating fuse 7 from being sheared under a shock. The pressure of the cartridge 8 alone should cause the translation of the piston 16.

FIG. 5 shows another embodiment in which the detonating fuse 7 does not traverse the wall of the tube 14, but instead passes at the back of said tube. In this case, if suffices to have a simple coupling member 28 between the detonating fuse 7 connected to the primer and the detonating fuse connected to the igniting composition 26, and the tightness system 9 can be eliminated.

The invention is in no way limited to the description given hereinabove and on the contrary covers any modification that can be brought thereto without departing from its scope. For example, the safety catch could be removed by means of a loading lever rather than by means of a push-button.

I claim:

1. A fire-arm comprising a firing tube having a longitudinal axis and adapted to contain therein a propellent charge, a primer, a hammer located opposite the primer, said hammer and said primer being positioned excentrically with respect to the axis of the firing tube, a pyrotechnic transmission chain for connecting the primer to the propellent charge and transmitting the whole energy from the hammer to the propellent charge, mechanical means for actuating the hammer, and mechanical breaking means for breaking the pyrotechnic transmission chain during storage; wherein the said mechanical means for actuating the hammer cooperate with said mechanical breaking means to cause the pyrotechnic chain to come into an unbroken state when the hammer moves under the effect of said mechanical means for actuating the hammer, and spring means cooperating with said mechanical breaking means to return the latter to their initial position breaking the pyrotechnic transmission chain when said mechanical means for actuating the hammer are released.

2. The fire-arm of claim 1, wherein the mechanical breaking means comprise a rotary bush having a portion thereof which is constituted by a cam cooperating with said mechanical means for actuating the hammer.

3. The fire-arm of claim 1, wherein the mechanical breaking means comprise a retractable flap having a portion thereof which cooperates with said mechanical means for actuating the hammer.

4. The fire-arm of claim 1, wherein the mechanical means for actuating the hammer cooperate with loading safety means, wherein the said mechanical means for actuating the hammer are prevented from moving when said loading safety means are interlocked.

5. The fire-arm of claim 1, wherein the pyrotechnic transmission chain comprises a pyrotechnic fuse which goes through the wall of the firing tube at the level of the propellent charge, and sealing means which are provided around the portion of the pyrotechnic fuse which goes through the wall of the firing tube.

6. The fire-arm of claim 1, wherein the pyrotechnic transmission chain comprises a first pyrotechnic fuse which is internal to said firing tube and a second pyrotechnic fuse which is external to said firing tube, wherein said first and second pyrotechnic fuses, are connected together close to the rear portion of said firing tube.

7. The fire-arm of claim 1, wherein the firing tube comprises a first part and a second part which are connected together by means of a locking ring, and a lock-check integral with said locking ring is provided for preventing the hammer from moving whilst the locking ring does not completely lock the first and second parts of the firing tube ring.

8. The fire-arm of claim 4, wherein the mechanical means for actuating the hammer comprise a portion constituted by a lug and the loading safety means comprise a push-member and a spring leaf provided with an opening wherein, in a first position of said push member, the spring leaf is set in a position which prevents the mechanical means from actuating the hammer from moving and in a second position of said push-member, the spring leaf is set in a position which allows the passage of said lug through the opening of said spring leaf to permit free manoeuvring of the mechanical means for actuating the hammer.

9. A fire-arm comprising a firing tube having a longitudinal axis and adapted to contain therein a propellent charge, a primer, a hammer located opposite the primer, said hammer and said primer being positioned excentrically with respect to the axis of the firing tube, a pyrotechnic transmission chain for connecting the primer to the propellent charge and transmitting the whole energy from the hammer to the propellent charge, mechanical means for actuating the hammer, and mechanical breaking means for breaking the pyrotechnic transmission chain during storage; wherein the said mechanical means for actuating the hammer cooperate with said mechanical breaking means to cause the pyrotechnic chain to come into an unbroken state when the hammer moves under the effect of said mechanical means for actuating the hammer, wherein the pyrotechnic transmission chain comprises a pyrotechnic fuse which goes through the wall of the firing tube at the level of the propellent charge, and sealing means around the portion of the pyrotechnic fuse which goes through the wall of the firing tube.

* * * * *